United States Patent [19]

Weder et al.

[11] Patent Number: 4,491,217

[45] Date of Patent: Jan. 1, 1985

[54] CORSAGE BAG, BLANK AND METHOD OF FORMING SAME

[75] Inventors: Erwin H. Weder; Donald E. Weder, both of Highland, Ill.

[73] Assignee: Highland Supply Corp., Highland, Ill.

[21] Appl. No.: 349,005

[22] Filed: Feb. 16, 1982

[51] Int. Cl.[3] ..... B65D 65/16

[52] U.S. Cl. ..... 206/45.33; 206/423; 206/457; 206/459; 383/106; 383/107; 383/120; 229/87 P

[58] Field of Search ..... 206/45.33, 423, 457, 206/459; 229/53, 55, 87 P, 87 R, DIG. 3, 88, 48 T; 156/203, 217, 218, 226, 227, 277; 428/35, 194, 204; 493/53, 54, 55, 187, 270; 383/106, 107, 120

[56] References Cited

U.S. PATENT DOCUMENTS

| | | | |
|---|---|---|---|
| 1,815,261 | 7/1931 | Kemp | 206/45.33 |
| 2,114,624 | 4/1938 | Bergstein | 156/218 |
| 2,320,326 | 5/1943 | Avery | 156/203 |
| 2,615,487 | 10/1952 | Cunnigham | 156/218 |
| 3,179,327 | 4/1965 | Burton et al. | 206/459 |
| 3,207,421 | 9/1965 | Hunger et al. | 206/459 |
| 3,355,303 | 11/1967 | Meyers | 229/53 |
| 3,647,134 | 3/1972 | Carnevalino | 229/53 |
| 3,659,775 | 5/1972 | Truman | 229/53 |
| 3,970,241 | 7/1976 | Hanson | 229/53 |
| 4,091,927 | 5/1978 | Lunsford | 206/459 |
| 4,216,620 | 8/1980 | Weder et al. | 229/87 P |
| 4,297,811 | 11/1981 | Weder | 229/87 P |

*Primary Examiner*—Joseph M. Moy
*Assistant Examiner*—David Fidei
*Attorney, Agent, or Firm*—Silverman, Cass & Singer, Ltd.

[57] ABSTRACT

A bag for displaying and protecting a corsage of fresh flowers or the like in handling and transporting the same, the bag being formed from a printed blank of flexible transparent plastic film by suitable manipulation and having a printed field serving as background for the corsage or flower. The blank is printed in such a manner that when the bag is formed, the printed field will be visible through the thickness of the rear wall and through the front wall which is transparent, there is a clear space for enabling the overlapped edges of the blank to be welded outside of the presence of the printed background to form a tube, and the bottom and top ends of the resulting tube being also clear to enable welding of the bottom end beyond the presence of the printed field. The top end of the resulting bag also has a clear space where the bag will be closed by the florist. The blank for each bag is cut from an elongate strip that is printed with rectangles of suitable dimension and spacing to produce the desired results when the bag blanks are severed and formed into bags.

4 Claims, 5 Drawing Figures

CORSAGE BAG, BLANK AND METHOD OF FORMING SAME

FIELD OF THE INVENTION

This invention relates to a corsage bag of flexible plastic film intended to hold a corsage or spray of fresh flowers and protect the same during handling and transportation but which will have a pleasing and ornamental appearance even while so contained in the bag. This is achieved by a decorative printed background against which the corsage or the like will be seen.

BACKGROUND OF THE INVENTION

Corsage bags of the general type with which this invention is concerned made out of flexible plastic film are known and have been used for many years. The typical bag is formed as a tube with pleat-folded sides and a closed bottom almost like the familiar kraft grocery bags, the bottom being sealed by heat or electronic welding and the top end being left open. Inside the bag, on the surface of one wall which becomes the rear wall of the bag, a rectangular member of cardboard or chipboard is affixed, this member having an ornamental finish produced by printing or the like. The rectangular member covers most of the rear wall and furnishes a background against which the corsage or the like is advantageously displayed.

The corsage bag described is purchased by florists in flat condition and when used is expanded, the corsage inserted and the open end folded and sealed by pins, staples or heat welding. The ornamental background member does not extend completely to the open edge thereby leaving an area which can be folded and closed by the florist without interfering with the background member which is usually stiff enough to resist folding.

The known corsage bag described above is expensive because each bag must be made in a manner requiring operations assembling two parts. The background insert must be made and handled in addition to the plastic bag part and the insert per se is expensive. The bag is heavy and stiff and may not follow the graceful contours of flowers placed therein.

The bag of the invention is extremely economical while being very effective to protect and display the corsage therein to its best advantages. It eliminates the insert mentioned above but necessitated the solution to several problems before it could become a practical product. These include application of a background in such a manner that the assembly of the bag is not interfered with, the establishment of a pattern of indicia on a blank which would provide the desired background while leaving areas clear for certain purposes to be explained. In addition, the invention enables long and continuous strips of plastic film to be printed on a production line and then fed into automatic machinery, if desired, for producing the bag of the invention.

All of the disadvantages of the prior bag have been eliminated.

Prior art patents are known in the general field including Nos. 2,774,187; 3,271,922; 3,376,666; 4,006,561; 4,189,868; and 4,216,620. No inference should be drawn that these patents represent a comprehensive list of the prior art or that they are relevant or pertinent to the invention.

SUMMARY OF THE INVENTION

A bag for displaying and protecting a corsage or fresh flowers formed of a rectangular blank of transparent, flexible plastic film, the bag having pleated side gussets and formed as a tubular member during its manufacture by overlapping and sealing opposite side edges of the blank. The sides of the tube are pleat-folded before reverse folding and sealing the bottom end of the bag. Prior to being formed into a tubular member, the blank has rectangles of ornamental printing applied thereto in the flat adjacent the said side edges of the blank and so located that when the tubular member is formed the rectangles will overlap and form a single rectangular printed field on the rear wall of the tubular member and hence on the rear wall of the bag after formation. The rectangles are printed on the surface of the rectangular blank which will become the exterior surface of the bag, are of such length that they do not extend to the ends of the formed tubular member so that there is a clear space at each end of the tubular member. The width of the rectangles and their dimensions are such that after the bag is formed the pleated side gussets and the front wall of the bag are clear, the resulting printed field being only on the rear wall and visible through the front wall of the bag. In this manner the printed field serves as an ornamental background for the flower spray or corsage.

The bag is sold with its top end extended thereby enabling the florist to open the bag, insert the flower or corsage, fold over the unprinted end and seal the same.

The invention contemplates a single blank of suitable construction to enable the bag to be formed manually or in automatic machinery and also contemplates an elongate printed strip having the printed rectangles theron in particular location and dimensions so that the strip may be passed through automatic machinery for separation into blanks and thereafter forming the bags.

DESCRIPTION OF THE PREFERRED EMBODIMENT

Figure 1:
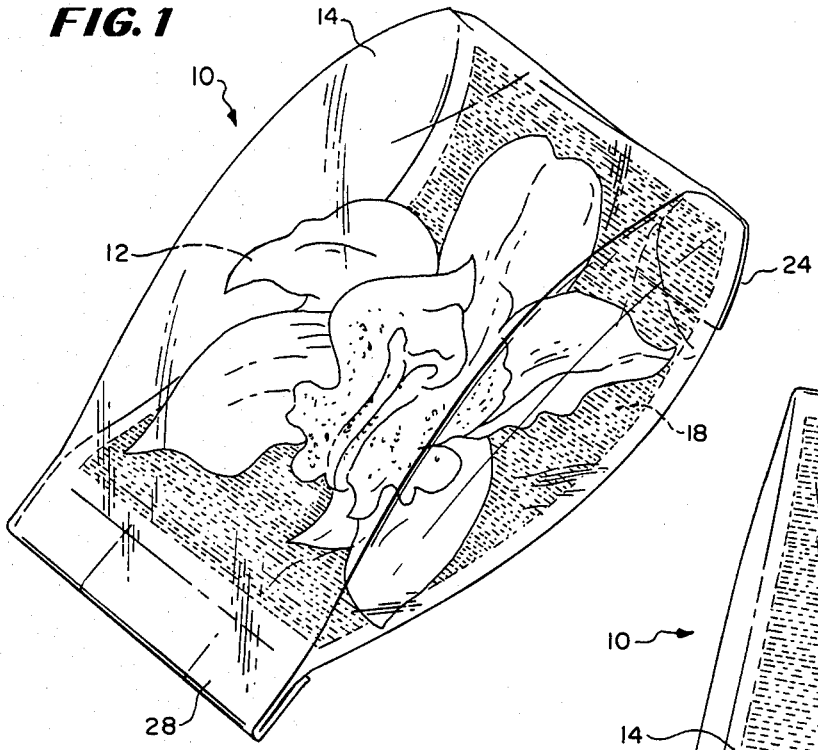
FIG. 1 is a perspective view of a bag constructed according to the invention having a corsage therein and being closed off.
Figure 2:
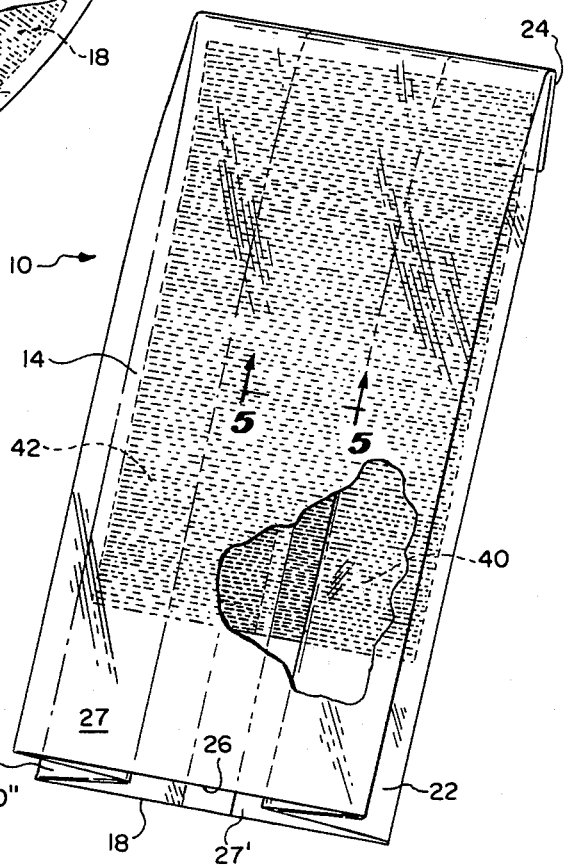
FIG. 2 is a perspective view of the same bag but in open condition, and being shown without any contents in its unexpanded condition.

The bag of the invention is designated generally by the reference character 10 and is shown in completed form in FIGS. 1 and 2 wherein the unexpanded flat bag is seen in FIG. 2 while the bag in use with an interior corsage is shown in FIG. 1. The florist has expanded the bag 10 in any suitable manner, has inserted a corsage or the like as seen at 12, has folded the open or top end upon itself and sealed the same by pins or tape or heat-sealing. The bag 10 remains expanded and the flower 12 is fully displayed therein to ornamental advantage by virtue of the fact that all walls of the bag 10 are transparent but for the rear wall which forms a background for the flower.

The bag 10 has a front transparent wall 14, a rear wall 18 that is ornamented in a particular manner, pleated sides 20 and 22, a closed end 24 which will be termed the bottom of the bag 10 and an open end 26 which will be called the top end. In use, the open end 26 will be closed by folding over the adjacent areas 27 and 27' to form the closure fold 28 as seen in FIG. 1. As will be explained, these areas 27 and 27' are devoid of printed ornamentation for a specific purpose. The area 27 is part of the front wall 14 and the area 27' is a part of the rear wall 18.

Figure 3:
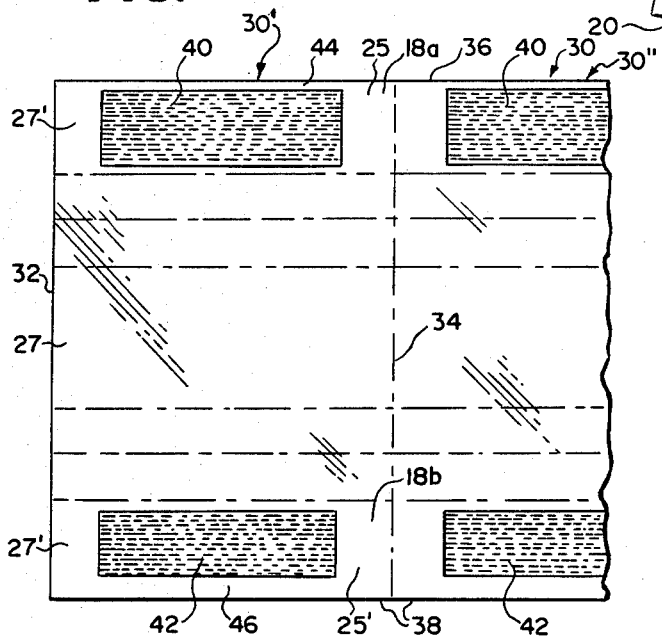
FIG. 3 is a top plan view of a fragment of an elongate strip of transparent plastic film which has been printed with the rectangles of the invention for use in forming the bags of the invention and illustrating one complete blank and a portion of an adjacent blank before severing of the blanks.

The bag 10 is formed of a single blank of transparent, flexible plastic sheeting preferably severed from an elongate strip of these blanks. In FIG. 3 there is illustrated a portion of such a strip which is generally designated 30 having the individual blanks such as 30' and 30'' formed thereon along its length. Only a portion of the blank 30'' can be seen and it can be presumed that the strip 30 continues to the right of the blank 30''. It is presumed that the blank to the left of the blank 30' has already been severed leaving the straight edge 32. The broken lines of this Figure will normally not be visible on the strip and are marked off in order to enable a clear explanation of the invention. The line 34 is a cutting line and all of the other lines are fold lines which result from operation of the automatic machinery forming the bags.

Attention is now invited to the view of FIG. 3 to gain an understanding of the construction of the bag 10 and to enable an appreciation of the benefits and advantages of the invention.

In the course of producing the strip 30 the transverse dimensions are chosen with a view toward achieving a bag 10 of a given width because the side edges 36 and 38 of the blank will be joined to form the single seam that is present along the length of the bag. This seam can be seen in formation as an overlapped joining of the edges 36 and 38 in FIGS. 4 and 5. When welded or heat sealed together the seam will be practically invisible. One would consider the space to be occupied by the two pleated gussets 20 and 22, the overlap of edge 38 past the edge 36, the finished width of the front and rear walls 14 and 18 and arrive at the length of the line 34 which is the width of the strip 30.

With regard to the length of the blank such as 30' this is determined by the desired length of the finished bag between the fold 28 and the closed end 24 as well as the amount of area to be used by the machinery in making the fold for the closed end 24 and the approximate extent needed by the florist to produce the fold 28. This gives the distance between the adjacent lines separating the blanks or, as in FIG. 3, the distance between the edge 32 and the line of severing 34.

Figure 4:
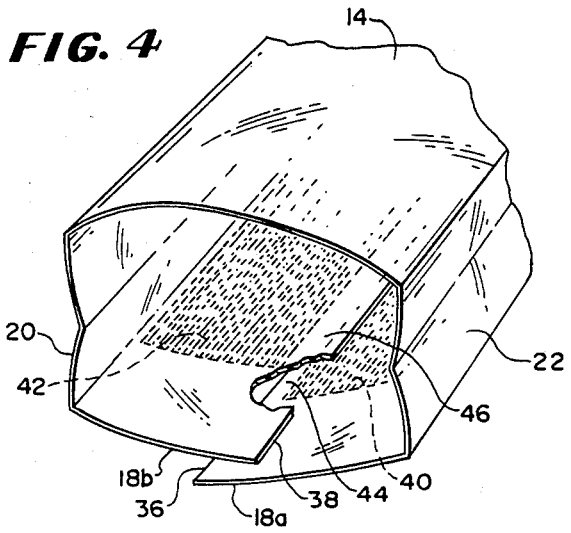
FIG. 4 is a fragmentary perspective view of a blank being formed into a tubular member to illustrate the manner in which the sides of the blank are connected, a portion being broken away to show details.

The rear wall 18 of the bag 10 is actually formed by the connecting of two panel portions **18*a* and 18*b* as best indicated in FIG. 4. As mentioned, this rear wall 18 carries a printed field, the purpose of which is to form an ornamental background for the corsage 12**. This is in lieu of the cardboard insert of the prior art.

In order to form the printed field, the blanks such as 30' and 30'' are imprinted on their rear surfaces with rectangular areas that will produce the required rectangular field on each bag. The areas chosen for the imprinting must be done in such a way that certain requirements are met and in addition must be done so that the automatic machinery will produce the desired results.

A review of the requirements are in order from a consideration of which one may acquire an understanding of the reasons for particular dimensions and placement of the printed fields.

It is necessary that the printed area be on the rear surface of the bag in order not to have any vapors or chemicals or pigments from the printed indicia adversely affect the delicate flowers which eventually will be substantially sealed within the bag 10. Accordingly the formation of the bag from the blank must bring the printed area to the exterior of the bag.

Where the blank edges overlap and sealing is to take place there must be clear areas to ensure a permanent seal by welding or heat sealing. Some printed pigments or solvents will prevent good sealing.

The same is true for the closed end of the bag which is produced during manufacture. Thus there should be a clear space at the bottom end of the bag to provide for good sealing. Additionally there is some esthetic value to having a clear visible area around the background indicia which will result if the printed indicia or background stops short of the bottom of the bag even considering that there will be a portion folded over upon itself. The clear areas for bottom folding are 25 and 25'.

As for the top or open end of the bag, it is again desirable to leave a clear area to enable the florist to close the bag by heat sealing or the like without interference from the pigment. In addition, the florist will invariably bring the fold around to the front where the printed material will be unsightly. Also, the florist will need more folding area than would an automatic machine since he is doing the closing-off manually. The clear areas are 27 and 27'.

In most instances of printed indicia, the combined effect of several printed impressions to produce a composite has a pleasing appearance when viewed through the clear member upon which the indicia has been applied while the rear of the printed material is unsightly. The manner of application of the printed material according to the invention ensures that no portion of the back of the printed indicia will be seen from the front of the bag after a corsage has been enclosed and the top end has been sealed.

Looking again at FIG. 3, it will be seen that there are two printed rectangles on each blank 30' and 30'' each being complete in itself and arranged adjacent and parallel to the respective side edges 36 and 38 of the strip 30. These rectangles are designated 40 and 42 and are located respectively on the panel halves **18*a* and 18*b*. Both are the same length, say for example in a typical case being about $6\frac{5}{8}$ inches long for a bag 10 which will have a tubular length of $8\frac{7}{8}$ inches before being formed into a bag. In other words, the distance between the edge 32 and the line of severance 34 is $8\frac{7}{8}$ inches in the example being described. This leaves a space of about $2\frac{1}{4}$ inches more or less which is clear, there being spaces end-wise of the rectangular areas 40 and 42**.

This space can be divided between the end areas in any desired proportion. Preferably the end which will become the top or open end should have at least about an inch to give the florist sufficient area to fold over and seal. The bottom end which will become the closed fold 24 need have only that amount of space which will enable folding in a suitable sealing machine to an extent which will provide sealing without including any of the background printed area. In the example being described, the area was divided as one inch for the bottom end and an inch and a quarter for the top or open end.

The two rectangular areas 40 and 42 have different widths and different placement on their respective panel halves. The larger of the rectangles is 40 and this is located closer to the edge 36 than the narrower rectangle 42 is located relative to the edge 38. For the example which is being specifically described, the width of the area 40 was about 2⅛ inches and it was located about ⅛ inch from the edge 36. This left the narrow clear strip 44 alongside the said edge 36. The width of the area 42 was about 1⅝ inches and it was located ⅝ inch from the edge 38, this providing the clear strip 46 alongside the edge 38.

In forming the bag 10, the first step requires that the blank 30' be reverse bent upon itself with the printed areas 40 and 42 on the exterior of the resulting roll and with the edge 36 overlapping the edge 38 and being on the exterior of the tube being formed. The strip 46 is now overlaid by the strip 44 but it should be noted that the printed surface of the panel **18*a* is on the exterior so that the surface which is engaged against the panel half 18*b* has no printed area on it. The strip 46 thus presents a relative wide area to enable engagement of the flap of panel 18*a* thereto such that in welding the two panel halves together there will be little or no intervening printed matter between the welded surfaces. This, clearly, is the reason for the wider clear strip 46 being left alongside the edge 38**.

Figure 5:
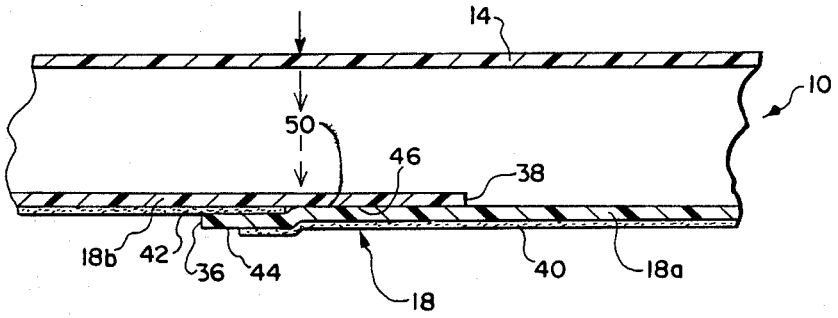
FIG. 5 is a fragmentary sectional view taken generally through the bag along the line 5—5 of FIG. 2 and in the indicated direction, but on an exaggerated scale.

The best view of the resulting joint in exaggerated dimensions is shown in FIG. 5. With a typical overlap of ⅞ inch the two rectangular areas 40 and 42 will overlap by about ⅛ inch so that when viewed through the front wall 14, i.e., in the direction of the arrow in FIG. 5 the areas will appear to comprise one uninterrupted rectangular area or field of printed indicia on the rear wall while in fact the printed indicia is on the exterior or bottom surface of the rear wall. Because the indicia is pigment, either of the usual type or even metallic, the flexibility of the rear wall 18 is not adversely affected.

The entire exterior surface of the strip 46 is available for welded engagement with the interior surface of panel half **18*a*. The joint resulting is strong and uninterrupted by printed matter and is indicated at 50 in FIG. 5**.

After the tubular member has been formed as explained thus far, the sides of the tubular member are folded inward in pleats or gussets on opposite edges of the tubular member to form these pleats as shown at 20 and 22. In this arrangement the width of the resulting tube in the example being specifically described is about 4 inches. The strip 30 for this example is cut to a width of 14 inches. Each of the pleats 20 and 22 is one inch deep so that the pleats when folded occupy a total of about 4 inches. This enables the bag to expand to a rectangular cross section of roughly four inches by two inches. Recalling that the combined width of the two rectangular areas 40 and 42 was about 3⅞ inches and that when the bag is formed there is about ⅛ inch overlap, the field of the resulting printed indicia is 3¾ inches wide. Thus this field is placed in the rear wall 18 in such a way that it is substantially confined to that area. This gives the most desirable ornamental effect.

The flattened tube with the pleats formed is then closed off by folding the clear portions 25 and 25' upon themselves including the ends of the pleats and welding the resulting joint to form the fold 24 seen in FIGS. 1 and 2.

The bag 10 is now in the flattened condition shown in FIG. 2 suitable for storage and shipping in small space. The bag can accept a flower or corsage 12 after which the florist will fold over the clear end 27, 27' and seal it to form the fold 28. In this condition the bag 10 is somewhat expanded and protects the flower while enabling it to be seen against a background of the printed material. If the florist uses a sealing device the bag is not readily compressible if filled with air.

The example given is not intended to be limiting since the bag is capable of being made to any desired dimensions for the purposes intended.

The printed matter or indicia can be applied by any suitable technique which is known. For example, multicolor printing is effected in rotary presses or by hand blocking or by silk-screening. The blanks such as 30' and 30'' could be individually produced in a suitable printing press and then fed to an automatic or semiautomatic machine for assembly. It is preferred however, that the blanks be integral with an elongate strip and fed to automatic machinery which severs and forms the bags.

The invention is capable of considerable variation in its details without departing from the spirit or scope of the invention as set forth in the appended claims.

What it is desired to secure by Letters Patent of the United States is:

1. A bag for transport and display of a corsage or the like formed as an integral tubular member of flexible film having a closed bottom end and an open top end, front, rear and opposite side walls, the side walls being expandible, the front and side walls being transparent in order to enable viewing of the contents of the bag when same is in use, a rear wall having a field of printed indicia on the exterior surface thereof for providing an ornamental background for any contents of the bag and said printed indicia being of a nature not adversely to affect the flexibility of said rear wall, the said closed bottom end comprising an extension of said tubular member which has been folded upon itself and sealed, said top end comprising a relatively short section of said tubular member including a portion of the rear wall and adapted when an article has been placed in the bag to be folded over upon itself by the user to enclose the bag, said field of printed indicia being substantially congruent with the rear wall excluding any part of the rear wall which has been folded into said extension to form said closed bottom end and also excluding the portion of said rear wall included in said relatively short section, whereby neither the folded end of the closed bottom nor the folded top end if made by the user will include any printed indicia, and wherein the tubular member is formed from a flat rectangular blank bent upon itself and joined by a seam, there being separate areas of printed indicia spaced from respective opposite side edges of the blank which are joined, the edges being joined in an overlap with the areas of printed indicia being disposed on the exterior of the tubular member and the areas being arranged side by side so that in effect a single combined area of said printed indicia is produced thereby forming said aforementioned field, said seam being interior to said overlap and being in the rear wall of said bag and in the center of said field.

2. The bag as claimed in claim 1 in which the separate areas are rectangles and the field is rectangular and has a width which is substantially the sum of the widths of the separate areas.

3. The bag as claimed in claim 1 in which one separate area of printed indicia is spaced from one side edge by a clear strip greater than the second separate area of printed indicia is spaced from the second edge, the second edge being overlapped upon the first edge whereby the inner surface adjacent the second edge is engaged against said clear strip and adhered thereto without intervening printed indicia.

4. A blank adapted to be formed into a bag for receiving a corsage or the like, the bag having a transparent front wall, transparent side walls adapted to be expandible, a rear wall having a field of printed indicia on the rear surface thereof formed of two joined areas of printed indicia with a central seam extending along the length of the bag, the indicia being visible through the front and side walls to serve as background for an article placed in the bag, the bag having a folded closed bottom end and an open top end, and comprising:

an integral rectangular member of transparent, flexible, plastic film whose short dimension is substantially equal to the length of the bag to be formed therefrom including the portion folded to form said bottom end and whose long dimension is folded to form said bottom end and whose long dimension is substantially equal to twice the width of the bag plus the transverse dimensions of the side walls plus a small fraction of said long dimension for overlap, two printed indicia areas on said blank which are rectangular in configuration and each parallel with the respective opposite short edges, the printed indicia areas having the same length which is substantially the same as the length of the bag to be formed without the folded end and without a short portion adjacent the open end to be formed, the printed indicia areas having their ends spaced inwardly from the opposite long edges of said rectangle by the amount of space required for the folded end and short portion, respectively, one printed indicia area being slightly wider than the other and spaced from short edge by a clear strip slightly narrower than the amount of the overlap, the second printed indicia area being spaced from the second short edge, if at all, by a clear strip substantially narrower than the amount of the overlap, the second edge adapted to be overlapped over the first edge in forming said bag and the adjacent inner surface of said second edge adapted to be adhered to said clear strip adjacent said first edge and interior to said overlap.

* * * * *